US005489885A

United States Patent [19]

Saga

[11] Patent Number: 5,489,885

[45] Date of Patent: Feb. 6, 1996

[54] AUTOMOTIVE FUSE INSERTING AND ATTACHING APPARATUS

[75] Inventor: Takashi Saga, Iwate, Japan

[73] Assignee: Sumitomo Wiring Systems, Ltd., Yokkaichi, Japan

[21] Appl. No.: 254,869

[22] Filed: Jun. 6, 1994

[30] Foreign Application Priority Data

Jun. 11, 1993 [JP] Japan ..... 5-031468 U

[51] Int. Cl.[6] ..... H01H 85/52; H01H 85/02; B25B 27/14

[52] U.S. Cl. ..... 337/216; 337/198; 337/257; 337/260; 361/833; 361/835; 439/250; 81/3.8

[58] Field of Search ..... 81/3.8; 337/197, 337/198, 216, 257, 260; 361/833, 835; 439/250, 366, 621, 622, 830

[56] References Cited

U.S. PATENT DOCUMENTS

| | | | |
|---|---|---|---|
| 3,732,516 | 5/1973 | Puetz | 337/194 |
| 4,687,270 | 8/1987 | Plyler | 439/350 |
| 4,806,118 | 2/1989 | Herrmann | 439/352 |
| 5,150,094 | 9/1992 | Babini | 337/214 |
| 5,338,228 | 8/1994 | Wright | 439/621 |
| 5,409,402 | 4/1995 | Ball | 439/621 |

FOREIGN PATENT DOCUMENTS

| | | |
|---|---|---|
| 58-9533 | 2/1983 | Japan . |
| 3-20855 | 2/1991 | Japan . |

*Primary Examiner*—Leo P. Picard
*Assistant Examiner*—Stephen T. Ryan
*Attorney, Agent, or Firm*—Beveridge, DeGrandi, Weilacher & Young

[57] ABSTRACT

An automotive fuse inserting and attaching apparatus that has an aligning portion for aligning automotive fuses to be inserted and attached into a fuse box. The aligned automotive fuses are aligned in the same arrangement they assume when inserted and attached within the fuse box. The automotive fuse inserting and attaching apparatus includes a feeding portion for feeding predetermined automotive fuses to the aligning portion. The automotive fuse inserting and attaching apparatus further includes a hand-type inserting and attaching portion that is separable from the feeding portion, for inserting and attaching a group of automotive fuses into the fuse box by conveyably clamping with one hand the group of automotive fuses aligned by the aligning portion.

20 Claims, 16 Drawing Sheets

AUTOMOTIVE FUSE INSERTING AND ATTACHING APPARATUS

CROSS REFERENCE TO RELATED APPLICATION

This application claims priority benefits under 35 USC §119 of Japanese Utility Model Application Serial No. 5-31468, the disclosure of which is incorporated herein by reference.

BACKGROUND OF THE INVENTION

1. Field of the Invention

The present invention relates to an automotive fuse inserting and attaching apparatus for collectively inserting and attaching, into a fuse box, a group of fuses to be used in a vehicle.

2. Description of the Related Art

Generally, automotive fuses are inserted and attached into a fuse box attached to a wire harness assembly which is an electric wiring system of a vehicle.

Referring to FIGS. 1 and 2, an automotive fuse has a casing F1 which is made of thin, flat, and plate-like resin, a portion to be blown F2 incorporated in the casing F1, a head portion F3, a trunk F4, shoulder-like projections F5 which are formed at the lateral sides of the head portion F3 and which transversely project with respect to lateral sides F4*a* of the trunk F4, thus forming a flange F6, and two plate-like terminals F7 which are arranged side by side and which project downward. In the present invention, the automotive fuse refers to a fuse having the specific configuration above-mentioned. Such automotive fuses are to be inserted and attached into a known fuse box having a great number of deep grooves into which the casings F1 are to be fitted, the deep grooves being formed in a single row or a plurality of rows at spatial intervals.

An inserting and attaching apparatus for inserting and attaching such fuses into a fuse box, is disclosed, for example, by Japanese Patent Examined Publication No. 58-9533 or Japanese Utility Model Laid-Open Publication No. 3-20855.

The former automotive fuse inserting and attaching apparatus comprises: arranging means for aligning predetermined automotive fuses in such a form as to be inserted and attached within a fuse box; guide means for guiding a group of automotive fuses aligned by the arranging means to the fuse box disposed at a predetermined position; and inserting and attaching means for inserting and attaching the automotive fuses thus guided.

The fuse box is to be attached, as assembled in a wire harness assembly, to a vehicle. In an actual production process, a wire harness assembly, which has been assembled as incorporating the fuse box above-mentioned, connectors and the like, is set on a predetermined inspection drawing board. Then, the wire harness assembly is checked for wiring and the terminals of the connectors and fuse box are tested for electrical conduction. After completion of such inspection, automotive fuses are inserted and attached into the fuse box on the inspection drawing board.

As shown in FIG. 3, a fuse box HB on an inspection drawing board TB is limited in movement by a great number of wire harnesses YH connected to the fuse box HB. In addition to the fact that an area where the fuse box HB can be moved is limited, the wire harnesses YH included in a wire harness assembly YHA congregate in such a limited area. Further, it is required to dispose, in such a limited area, connector inspection members TC to which the fuse box HB and the connector terminals are to be connected at the time of inspection of electrical conduction. It is therefore very difficult to dispose a member for positioning and securing the fuse box HB within the area where the fuse box HB can be freely moved.

It has been difficult to apply an automotive fuse inserting and attaching apparatus as shown in Japanese Patent Examined Publication No. 58-9533 above-mentioned, to such a fuse box which cannot be positioned and secured. Accordingly, automotive fuses have been conventionally manually inserted and attached, as picked one by one with the fingers, into a fuse box. This lowers the working efficiency. Further, when inserting and attaching a combination of a variety of types of automotive fuses having the same shape and sizes but having different capacities, there readily occur errors that fuses having predetermined capacities are not properly inserted and attached into predetermined positions due to human factors.

On the other hand, Japanese Utility Model Laid-Open Publication 3-20855 discloses an automotive fuse inserting and attaching apparatus which comprises: a grooved member having a great number of grooves into which automotive fuses are respectively inserted and attached; and a comb-like member having a great number of projecting plates which are moved back and forth in the grooves. This apparatus is arranged such that the comb-like member is advanced to push out all the automotive fuses at the same time, causing the automotive fuses to be inserted into a fuse box. In this automotive fuse inserting and attaching apparatus, automotive fuses to be inserted into respective positions of a fuse box are housed, in the form of lamination layers, in guide grooves in a laminating and setting member, and groups of automotive fuses to be pushed in are successively supplied according to the reciprocating movement of the comb-like member.

In this automotive fuse inserting and attaching apparatus, however, a large-size and heavy laminating and setting member in which a great number of automotive fuses are housed, is integrally disposed with the apparatus. Accordingly, when manually inserting and attaching automotive fuses in the manner mentioned earlier, the apparatus is very difficult to handle.

For the foregoing reasons, there is a need for an automotive fuse inserting and attaching apparatus with which automotive fuses can manually readily be inserted and attached, with high efficiency, into a fuse box assembled with wire harnesses.

SUMMARY OF THE INVENTION

The present invention is directed to an automotive fuse inserting and attaching apparatus which satisfies this need.

More specifically, the automotive fuse inserting and attaching apparatus according to the present invention comprises: aligning means for aligning automotive fuses to be inserted and attached into a fuse box, in such an arrangement as to be inserted and attached within the fuse box; feeding means for feeding predetermined automotive fuses to the aligning means; and hand-type inserting and attaching means adapted to be separable from the feeding means, for inserting and attaching a group of automotive fuses into the fuse box by conveyably clamping with one hand the group of automotive fuses aligned by the aligning means.

According to a preferred mode of the present invention, the feeding magazine is arranged such that, when predetermined automotive fuses are previously set in the grooves per row, a group of automotive fuses automatically sent along the grooves are aligned, by the aligning portion, in such a form as to be inserted and attached within a fuse box. The group of automotive fuses thus aligned, can be clamped by the clamping mechanism of the hand-type inserting and attaching magazine which is disposed as separated from the feeding magazine. Then, the automotive fuses can be collectively inserted into the fuse box.

Thus, a group of automotive fuses aligned, by the feeding magazine, in such a form as to be inserted and attached within a fuse box, can be collectively inserted, as clamped by the hand-type inserting and attaching magazine, into the fuse box. The inserting and attaching magazine for inserting and attaching automotive fuses into a fuse box, is disposed as separated from the feeding magazine for feeding the automotive fuses to the inserting and attaching magazine. It is therefore possible to make the inserting and attaching magazine in a compact and light-weight design which is easy to handle. Thus, automotive fuses can be manually inserted and attached readily and efficiently, with no errors about insertion and attachment, into a fuse box included in a wire harness assembly set on an inspection drawing board.

Regardless of the presence or absence of optional equipment for example, vehicles .generally share the same fuse box. More specifically, the fuse box is so-called standardized and automotive fuses for unnecessary optional circuits are not inserted and attached into the fuse box. Thus, automotive fuses are inserted and attached into the fuse box in a variety of forms with the fuse box lacking certain automotive fuses. According to the present invention, the stopper means prevents the advance of an automotive fuse into a selected row so that such a variety of insertion/attachment forms can be readily realized. Accordingly, automotive fuses can be further efficiently inserted and attached.

With the movable holding pieces slid, by the operating means, to the position where the clamping state is released, the clamping surface of the inserting and attaching magazine is brought near and opposite to the head portions of a group of automotive fuses aligned on the aligning portion of the feeding magazine. Then, with the head portions of the group of automotive fuses introduced between the stationary holding pieces and the corresponding movable holding pieces, the operating means is released. This causes the movable holding pieces biased by the biasing means to slide and clamp the head portions of the automotive fuses in cooperation with the stationary holding pieces. With the state above-mentioned, the inserting and attaching magazine is brought near the fuse box and the group of automotive fuses are collectively inserted, from the terminal sides thereof, into predetermined positions of the fuse box.

Thus, clamping the group of automotive fuses can be securely held by the biasing means, and such holding can be readily released by the operating means. Accordingly, the automotive fuses can be securely clamped and inserted into the fuse box with good maneuverability.

These and other features, objects and advantages of the present invention will be more fully apparent from the following detailed description set forth below when taken in conjunction with the accompanying drawings.

BRIEF DESCRIPTION OF THE DRAWINGS

By way of example only, a specific embodiment of the present invention will now be described with reference to the accompanying drawings in which.

DESCRIPTION OF PREFERRED EMBODIMENTS

Figure 1:
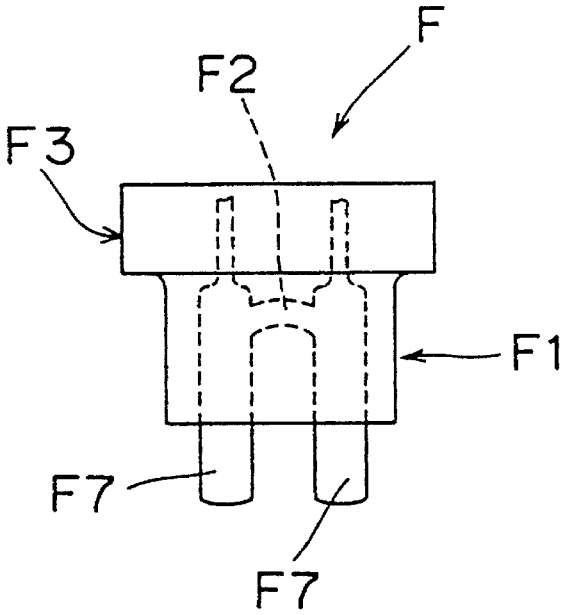
PRIOR ART FIG. 1
FIG. 1 is a schematic side view of an automotive fuse.
Figure 2:
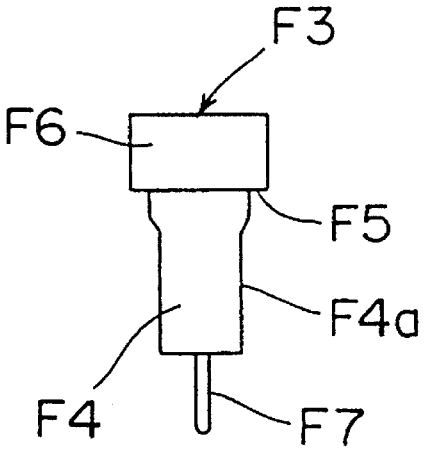
PRIOR ART FIG. 2
FIG. 2 is a schematic end view of the automotive fuse.
Figure 3:
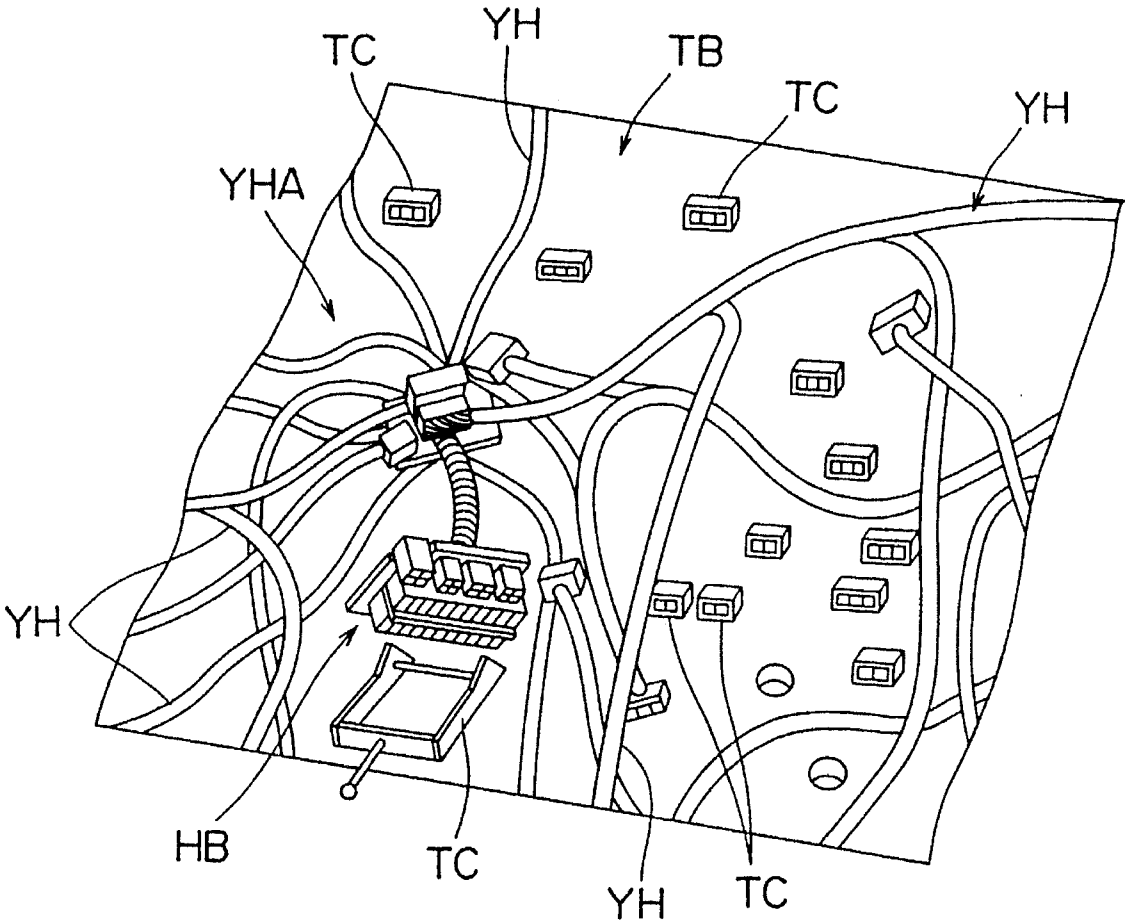
PRIOR ART FIG. 3
FIG. 3 is a perspective view of an inspection drawing board to which set is a wire harness assembly having a fuse box attached thereto.
Figure 4:
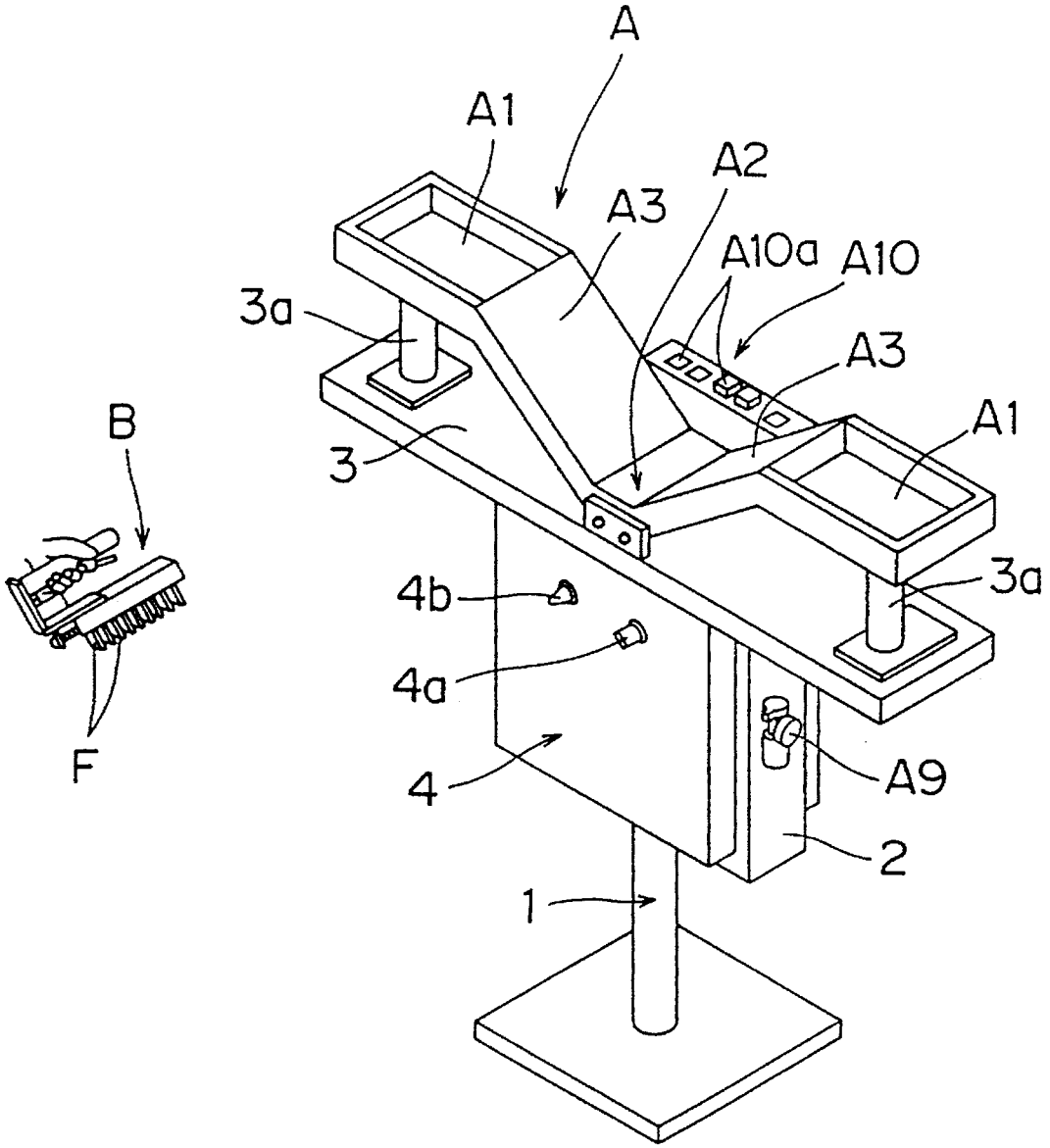
FIG. 4 is a perspective view of an automotive fuse inserting and attaching apparatus according to an embodiment of the present invention.

FIG. 4 is a general schematic perspective view of an automotive fuse inserting and attaching apparatus according to an embodiment of the present invention. Referring to FIG. 4, the automotive fuse inserting and attaching apparatus comprises: a feeding magazine A for feeding a group of automotive fuses F as aligned in such a form as to be inserted and attached within a fuse box; and a hand-type inserting and attaching magazine B disposed as separated from the feeding magazine A for collectively receiving, from the feeding magazine A, the automotive fuses F as aligned and for collectively inserting the automotive fuses F into the fuse box.

The feeding magazine A is installed on the top of a support plate 3 supported through a channel-like frame 2 by a leg portion 1 placed on a floor or the like. Attached to the channel-like frame 2 is a control box 4 provided on the front surface thereof with a power switch 4*a* and a power lamp 4*b*. In FIG. 4, a regulator A9 is disposed for setting the pressure of air to be supplied to air cylinders A8 (See FIG. 5) to be discussed later, and a selecting portion A10 has select buttons A10*a* each for selecting an air cylinder to be operated, out of the air cylinders A8.

Figure 5:
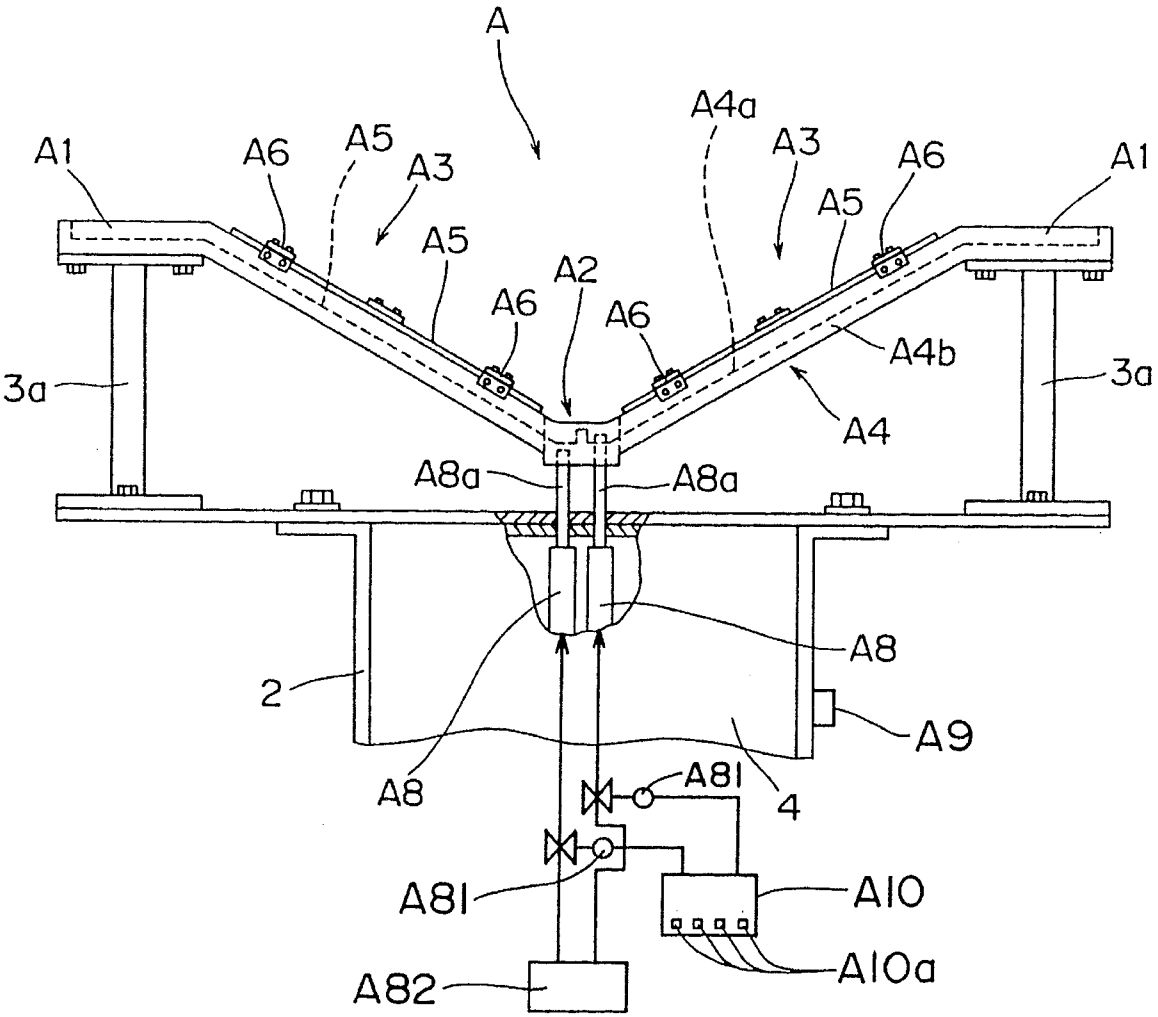
FIG. 5 is a partial section view in side elevation of the feeding magazine contained in the automotive fuse inserting and attaching apparatus.

Referring to FIG. 4 and also FIG. 5 which is a side view of the feeding magazine A, the feeding magazine A has, at both ends thereof, automotive fuse placing stands A1 each in the form of a container of which top is opened. Formed between the placing stands A1 is a portion of which section is substantially in a V shape in side elevation. A center horizontal portion of the substantially V-shape portion forms an aligning portion A2 for aligning a group of automotive fuses in such a form as to be inserted and attached within a fuse box. A pair of inclined portions by and between which the aligning portion A2 is located, form a pair of guide portions A3 for successively sending automotive fuses to the aligning portion A2.

Figure 6:
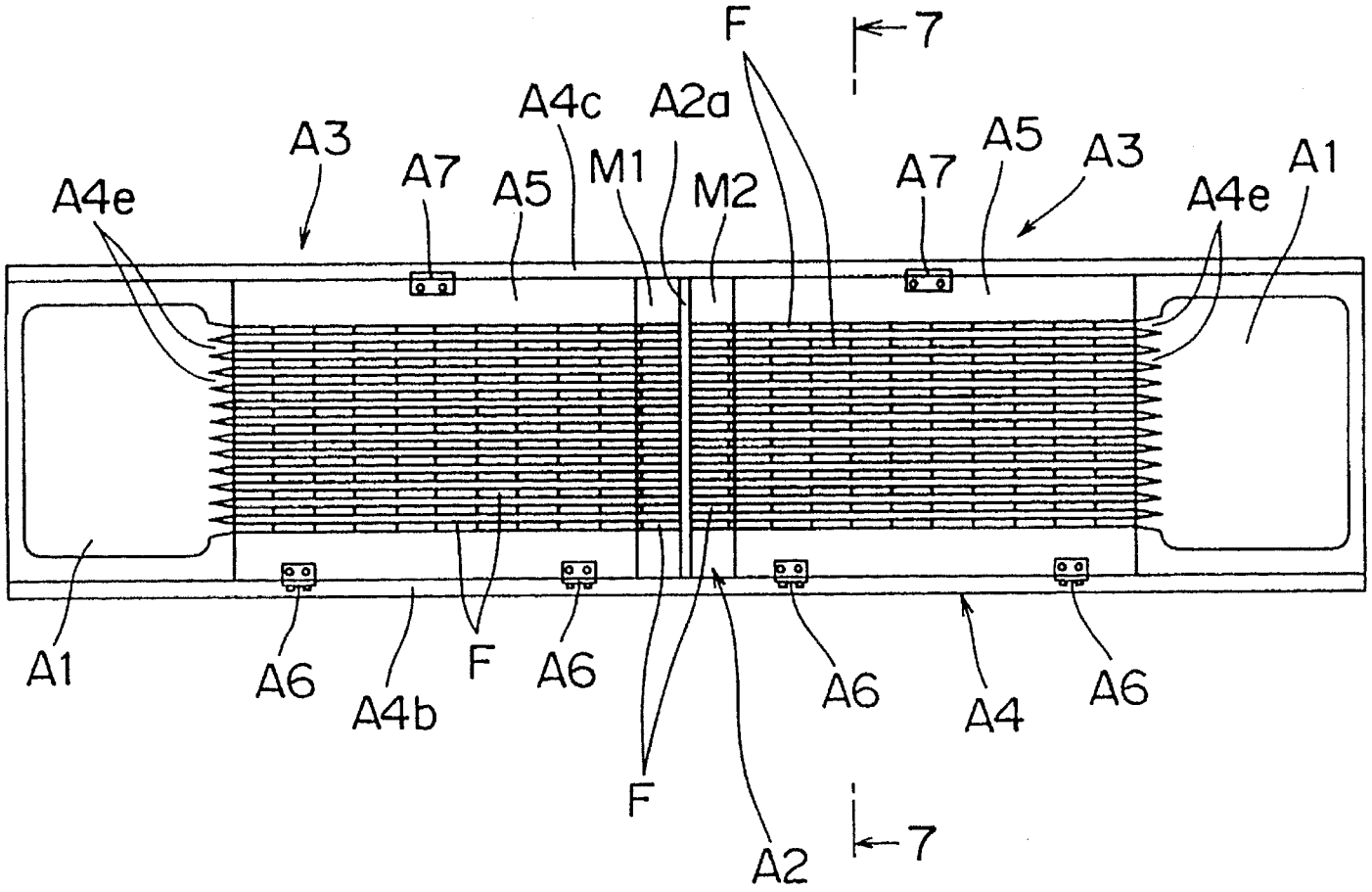
FIG. 6 is a plan view of the feeding magazine.

Referring to FIG. 5 and also FIG. 6 which shows the top surface of the feeding magazine A, the guide portions A3 and the aligning portion A2 are formed by a base member A4 of which section is substantially in a V shape in side elevation. Formed in the top surface of the base member A4 are long grooves A4*a* in a plurality of rows parallel with each other which extend from the guide portions A3 to the aligning portion A2. More specifically, the grooves A4*a* are formed as continuously extending from the guide portions A3 to the aligning portion A2.

Figure 7:
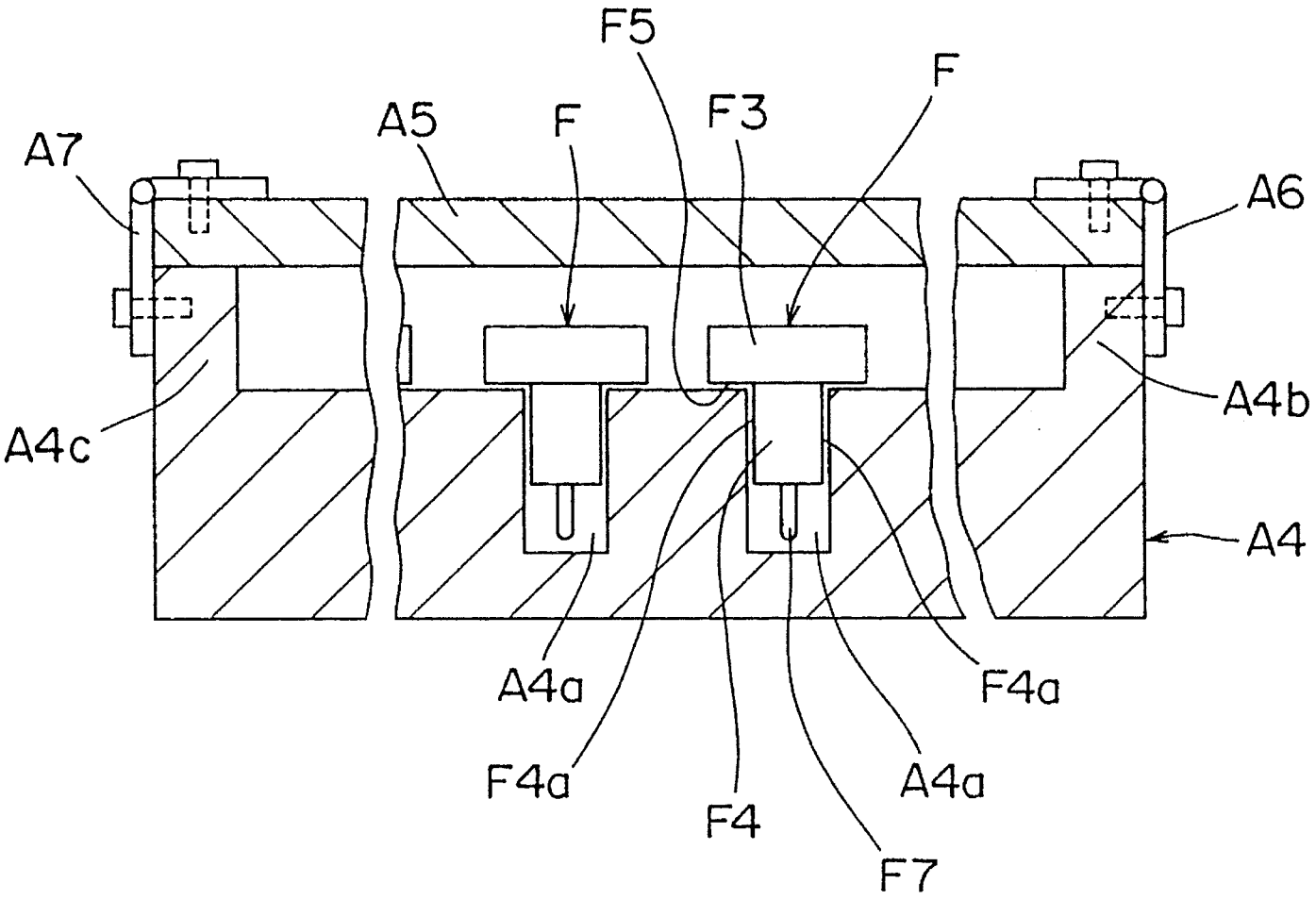
FIG. 7 is a section view taken along the line 7—7 in FIG. 6.

Referring to FIG. 7 which is a section view taken along the line 7—7 in FIG. 6, each of the grooves A4*a* has a width which is wider than the width of a lateral side F4*a* of the trunk F4 of an automotive fuse F, and which is narrower than the width of a lateral side of the flange F6. Accordingly, with the use of the shoulder-like projections F5, the automotive fuses F can be movably fitted into the grooves A4*a* as hung down the trunks F4 therein. Automotive fuses movably hung in the grooves A4*a* are aligned in rows of the grooves A4*a* and automatically sent, by own weight, toward the aligning portion A2 which is located downward in the inclination directions. The distance between adjacent grooves A4*a* is equal to the distance between adjacent automotive fuses as arranged within a fuse box. More specifically, the automotive fuses which are sent through the guide portions A3, are sent to the aligning portion A2 with the arrangement distance between adjacent fuses being equal to the arrangement distance between adjacent fuses within the fuse box.

Figure 8:
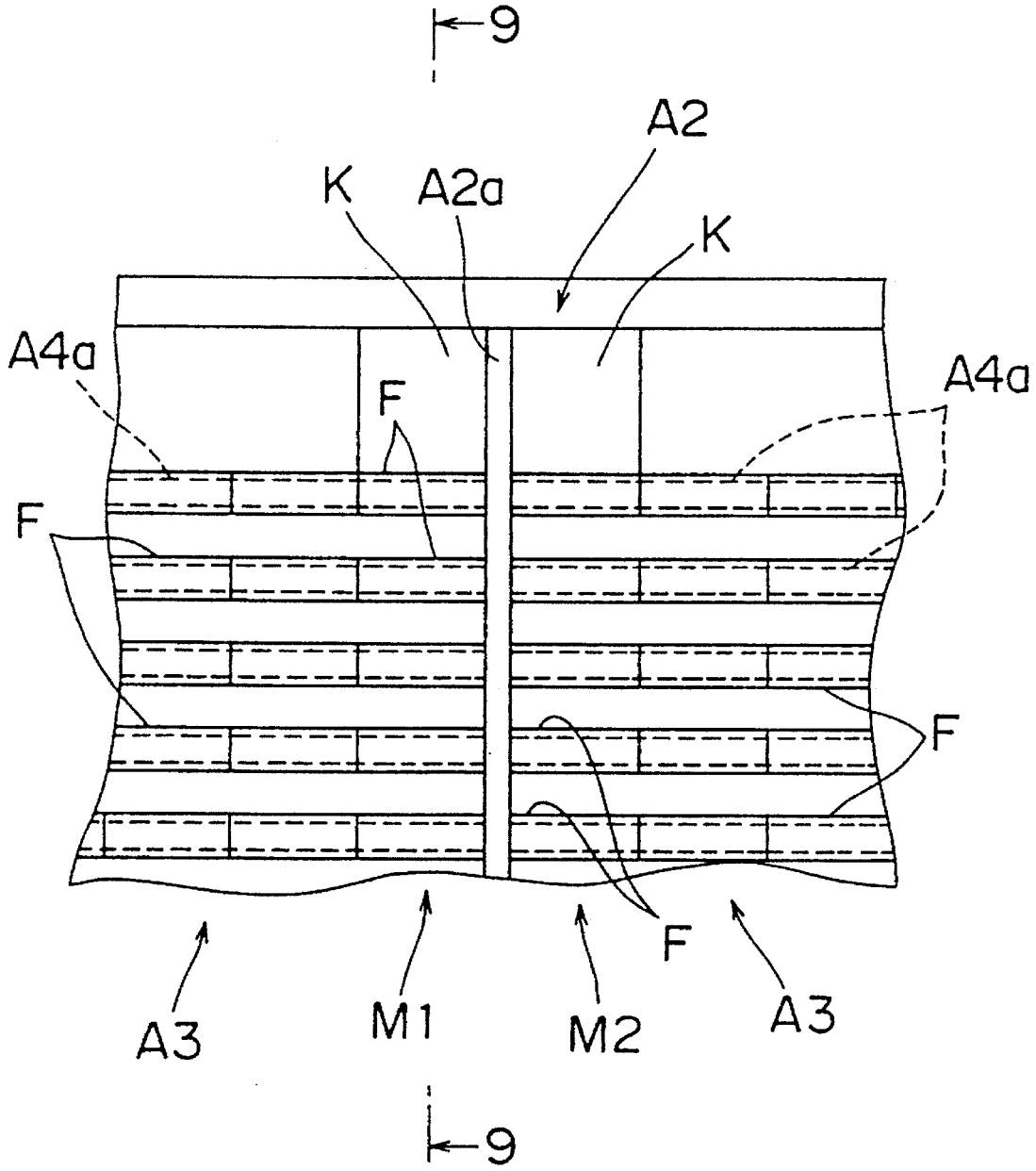
FIG. 8 is a partial enlarged plan view of the aligning portion of the feeding magazine.
Figure 9:
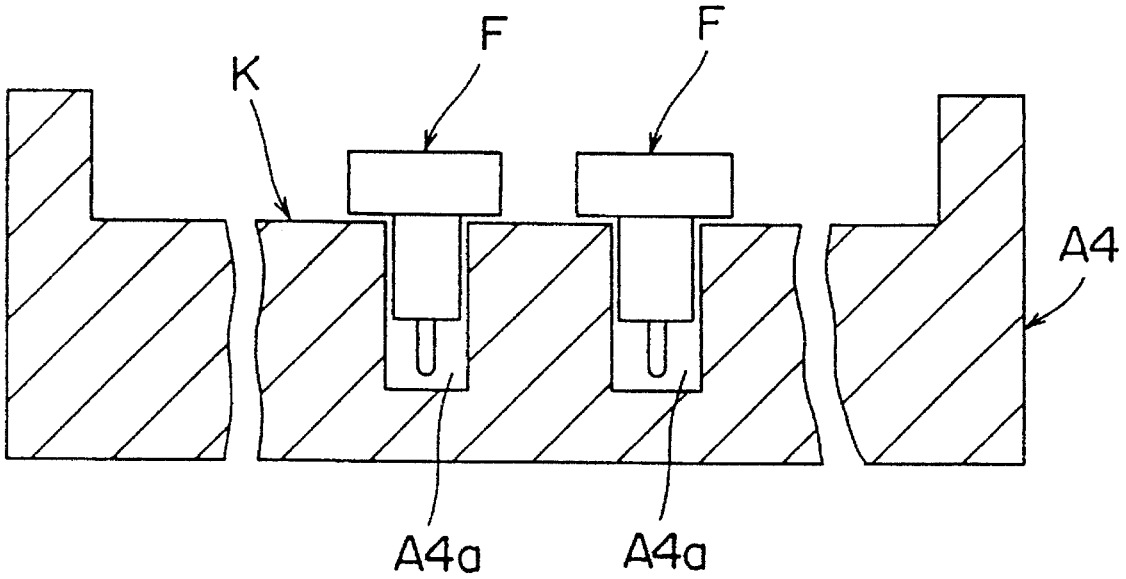
FIG. 9 is a section view taken along the line 9—9 in FIG. 8.

Referring to FIG. 8 which is an enlarged plan view of the aligning portion A2, and also to FIG. 9 which is a section view taken along the line 9—9 in FIG. 8, the aligning portion A2 is formed by the horizontal portion of the base member A4 and is opened above such that a group of automotive fuses F aligned in two rows M1, M2 on the aligning portion A2, can be clamped from above. A positioning projection A2*a* which crosses the grooves A4*a*, projects from the center of the top surface of the aligning portion A2 in the base member A4. The positioning projection A2*a* is adapted to come in contact with the end surfaces of the lead automotive fuses sent through the grooves A4*a*, thus positioning the distance between the rows of the automotive fuses to be aligned in the two rows M1, M2. More specifically, by the aligning portion A2, the lead automotive fuses sent from the guide portions A3 are aligned in the two rows M1, M2 extending along the direction which crosses the rows of the grooves A4*a*, such that the lead automotive fuses are arranged in such a form as to be inserted and attached within a fuse box. When a group of automotive fuses F aligned on the aligning portion A2 are pulled out by the inserting and attaching magazine B in a manner as will be discussed later, subsequent automotive fuses F sent through the grooves A4*a* are immediately aligned on the aligning portion A2. Referring to FIG. 9, the top surface of the base member A4 at the aligning portion A2 is formed as a reference surface K. This reference surface K is adapted to come in contact with a clamping surface B1*a*, to be discussed later, of the inserting and attaching magazine B, such that the magazines A and B are positioned with respect to each other.

Figure 10:
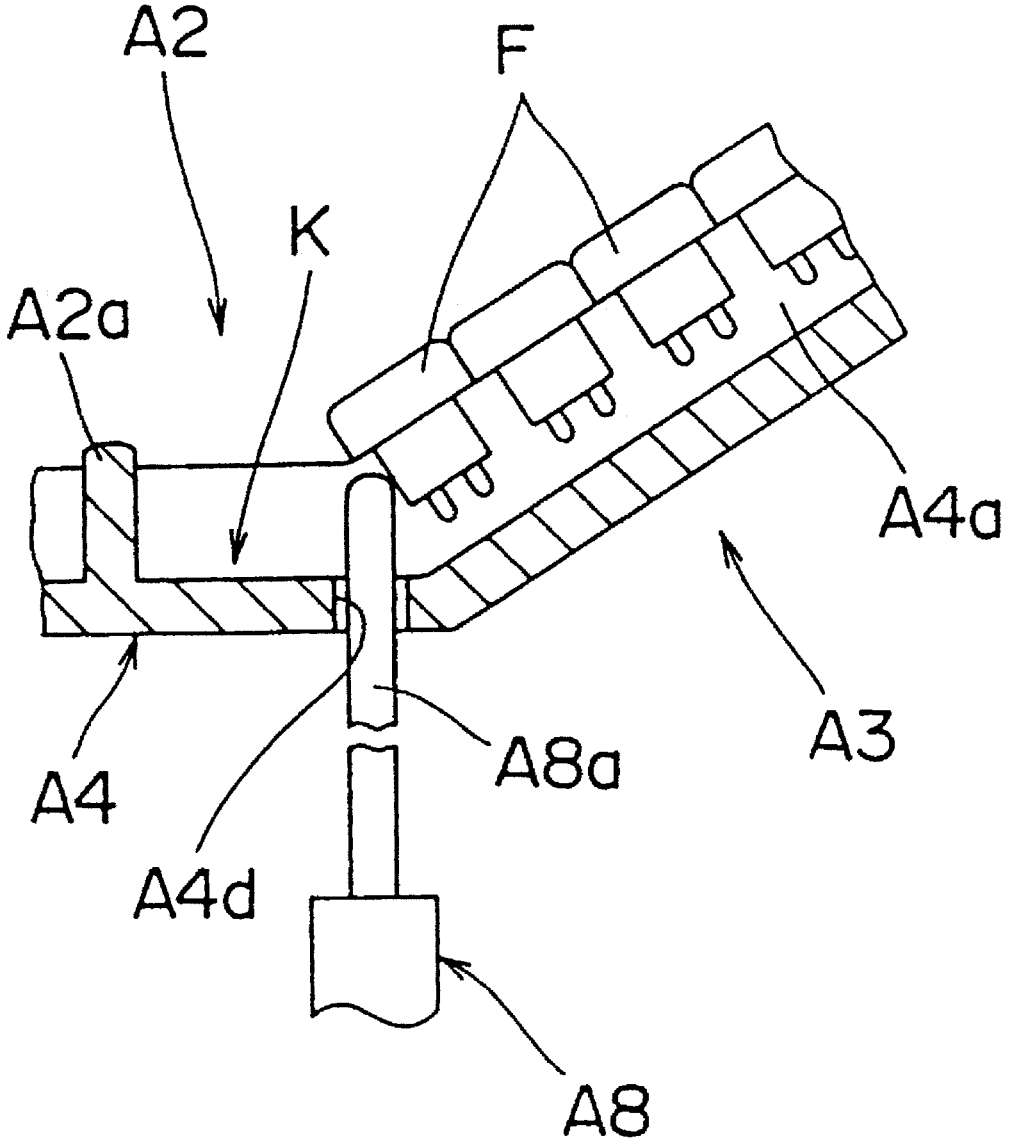
FIG. 10 is a vertical section view taken along the grooves in the base member of the feeding magazine.

Referring to FIG. 5 and also FIG. 10 which is a longitudinal section view along the grooves A4*a* in the base member A4, the air cylinders A8 serving as stopper means are disposed at the boundary portions between the aligning portion A2 and each of the guide portions A3, the air cylinders A8 being adapted to be movable as projecting into predetermined grooves A4*a* to stop the movement of automotive fuses. The air cylinders A8 are connected to a pressurized air supply source A82 through valves A81. When rods A8*a* of the air cylinders A8 project into selected grooves A4*a* through insertion holes A4*d* in the base member A4, this prevents the automotive fuses F in the selected grooves A4*a* from entering the aligning portion A2. The air cylinders A8 serving as the stopper means are not necessarily disposed for all the grooves A4*a*, but may be disposed only in grooves A4*a* for supplying automotive fuses corresponding to the fuse circuits of optional equipment.

The valves A81 are controlled by the selecting portion A10 serving as control means. The selecting portion A10 is formed by a microcomputer in which stored are the data of automotive fuses required per model number, and other electronic components. Provision is made such that, by pressing a desired select button A10*a*, the rod A8*a* of an air cylinder A8 projects into the groove A4*a* of a desired row only. This prevents the automotive fuse F from being sent to that part of the aligning portion A2 which meets with the selected groove A4*a*. It is therefore possible not to insert and attach the automotive fuse for the fuse circuit of optional equipment which has not been selected. The pressure of air to be supplied to each of the air cylinders A8 can be adjusted by the regulator A9 mentioned earlier. The select buttons A10*a* are disposed for opening/closing valves (not shown) which allow/prevent air supply to the air cylinders A8. Each of the select buttons A10*a* may be disposed as corresponding to each of the air cylinders A8, or a select buttons A10*a* may correspond to a plurality of air cylinders A8 for a specific model of a vehicle.

Referring to FIG. 5 to FIG. 7, lids A5 are attached to the guide portions A3, i.e., the inclined portions of the base member A4, such that the lids A5 can open/close the spaces above the guide portions A3. When the lids A5 are closed, the top surfaces of automotive fuses housed in the grooves A4*a* can be guided by the lids A5.

One lateral edges of the lids A5 are rotatably supported, through hinges A6, by one projecting edges A4*b* of the base member A4. Attached to the other lateral edges of the lids A5 are lock members A7 (hinges in this embodiment) which are engaged with the other projecting edges A4*c* of the base member A4 to lock the closing state of the lids A5. With the lids A5 opened after the locking state by the lock members A7 has been released, automotive fuses F can be housed in the grooves A4*a* from above. Thus, the automotive fuses F can be more readily set in the grooves A4*a*.

The lids A5 are transparent or semi-transparent such that, when the lids A5 are closed, the types of automotive fuses thereunder can be recognized. Generally, automotive fuses are classified by color according to capacities. It is therefore possible to readily judge, through the transparent or semi-transparent lids A5, whether or not proper automotive fuses are being set in each of the grooves A4*a*.

Figure 11:
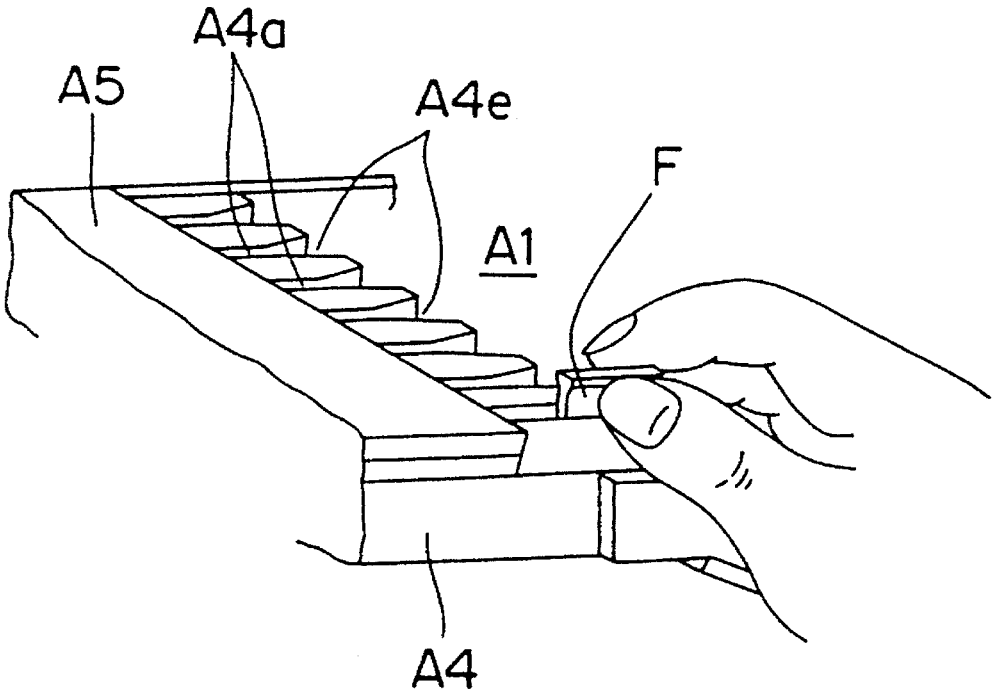
FIG. 11 is a perspective view of the introduction portions of the grooves in the feeding magazine.

Referring to FIG. 5 and FIG. 6, the placing stands A1 are supported by the support plate 3 through poles 3*a*. A great number of automotive fuses of a variety of types respectively having different capacities, may be placed on the placing stands A1 such that the automotive fuses thereon can be set to the guide portions A3 as necessary. Starting end portions A4*e* of the grooves A4*a* face the inside of the placing stands A1. As shown in FIG. 11, the starting end portions A4*e* are used for introducing automotive fuses into the grooves A4*a*. For facilitating such introduction, the starting end portions A4*e* are so formed as to become wider toward the placing stands A1.

Figure 12:
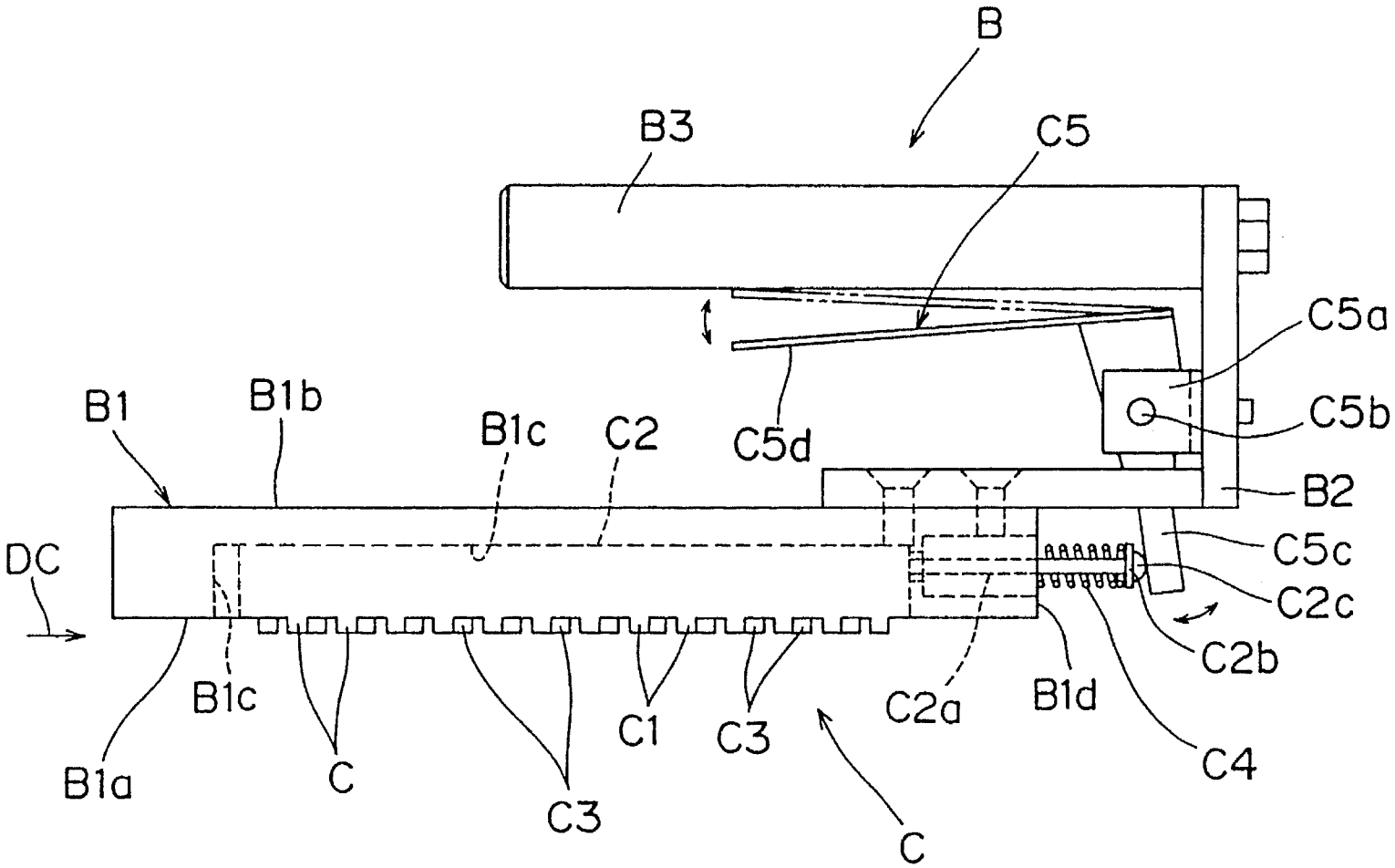
FIG. 12 is a side view of the inserting and attaching magazine.

Referring to FIG. 12 to FIG. 18, the inserting and attaching magazine B will be discussed. The inserting and attaching magazine B is so arranged as to clamp, in the form of alignment, the lateral sides of the flanges F6 of a group of automotive fuses F aligned on the aligning portion A2 of the feeding magazine A, and to collectively insert and attach such fuses into a fuse box. As shown in FIG. 12, the inserting and attaching magazine B comprises: a thick magazine body B1 in a rectangular plate shape; a rod-like grip portion B3 attached to one end of the top surface B1*b* of the magazine body B1 through an L-shape attaching member B2, such that the grip portion B3 is in parallel with the magazine body B1; and a clamping mechanism C disposed at the magazine body B1 for clamping the automotive fuses F as aligned.

Figure 13:
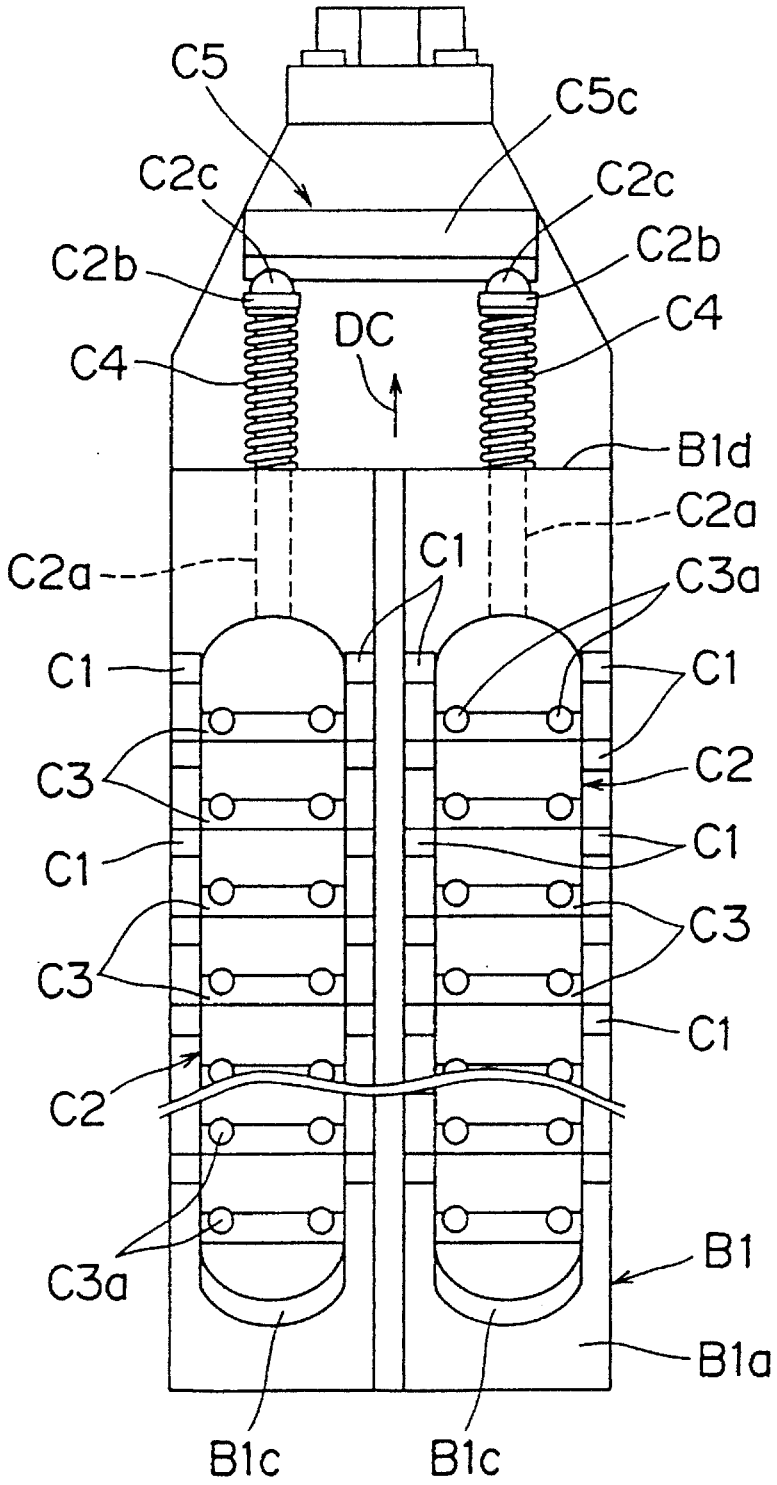
FIG. 13 is a bottom view of the inserting and attaching magazine illustrating the clamping surface thereof.
Figure 14:
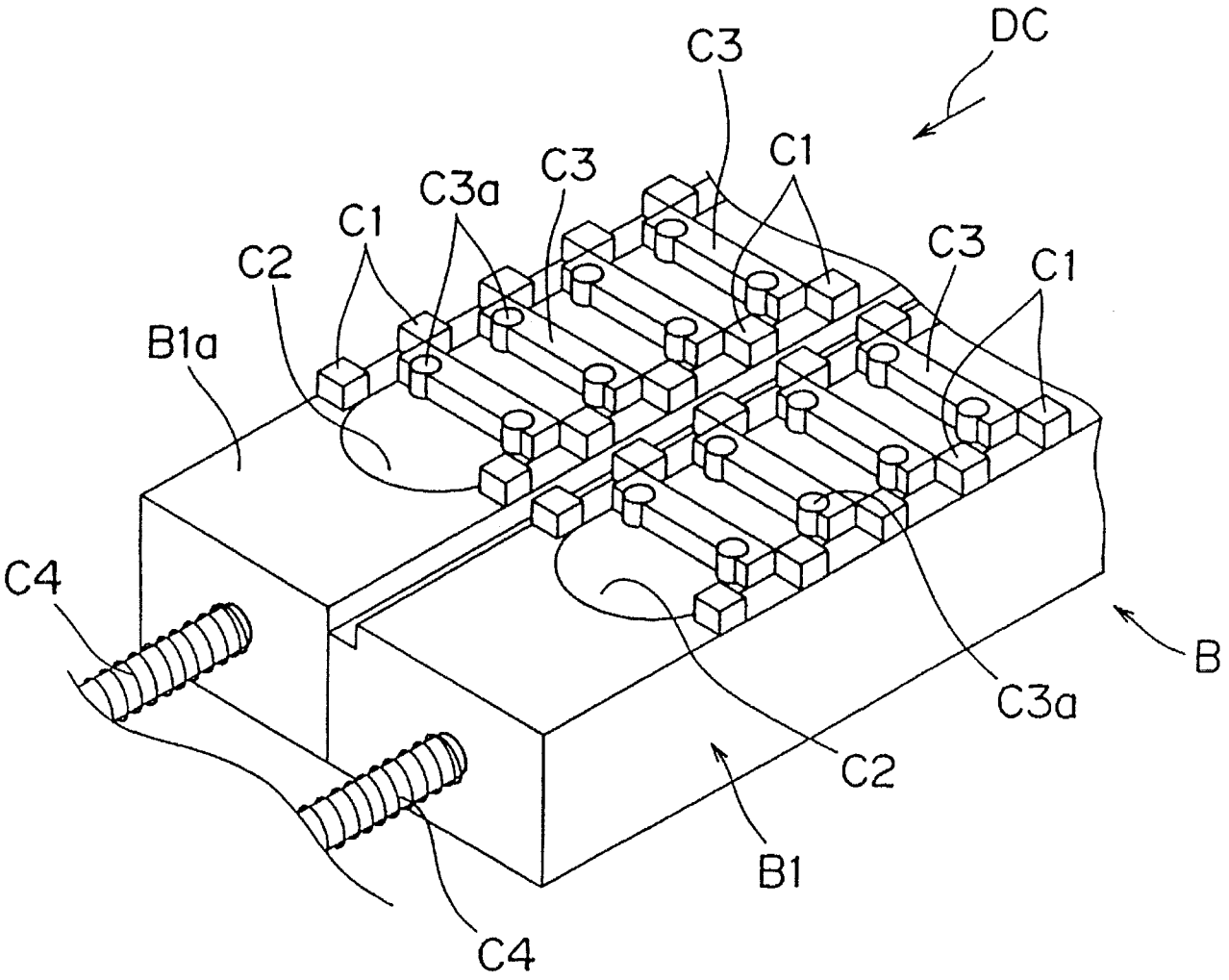
FIG. 14 is a perspective view of the bottom of the inserting and attaching magazine.

The following description will discuss the clamping mechanism C with reference to FIG. 12, FIG. 13 which shows the underside or clamping surface of the magazine body B1, and FIG. 14 which is a perspective view of the magazine body B1 in bottom elevation. The clamping mechanism C comprises: stationary holding pieces C1 which are formed as projecting from the clamping surface B1*a* of the magazine body B1 in four rows along the longitudinal direction thereof; slide plates C2 respectively slidably fitted in a pair of long grooves B1*c* formed in the clamping surface B1*a;* movable holding pieces C3 in two rows integrally formed at the slide plates C2 for clamping automotive fuses together with the stationary holding pieces C1; compression coiled springs C4 serving as biasing means for biasing the slide plates C2 in a clamping direction DC; and operating means C5 for sliding, against the biasing means, the slide plates C2 in such a direction as to release the clamping state.

In FIG. 13, provision is made such that the stationary holding pieces C1 in two rows at the left side and the movable holding pieces C3 in the left-side row clamp the automotive fuses F in the right row M2, and the stationary holding pieces C1 in two rows at the right side and the movable holding pieces C3 in the right-side raw clamp the automotive fuses F in the left row M1. Referring to FIG. 14, each of the movable holding pieces C3 is made in the form of a rectangular plate and cylindrical rubber portions C3*a* are fitted to the movable holding pieces C3 such that the rubber portions C3*a* partly expose from those sides of the movable holding pieces C3 which come in contact with automotive fuses. At the rubber portions C3*a,* the movable holding pieces C3 resiliently clamp the lateral sides of automotive fuses, so that the automotive fuses can be securely clamped.

Referring to FIG. 12 and FIG. 13, shafts C2*a* are integrally formed at the ends of the slide plates C2. The shafts C2*a* project from the magazine body B1 at its end at the side of the attaching member B2. Flange portions C2*b* and semispherical portions C2*c* are integrally formed at the tips of the shafts C2*a*. The compression coiled springs C4 which are loosely fit on the shafts C2*a,* are interposed between the flange portions C2*b* of the shafts C2*a* and an end surface B1*d* of the magazine body B1. The compression coiled springs C4 are adapted to bias, through the shafts C2*a* and the slide plates C2, the movable holding pieces C3 in the clamping direction DC.

Referring to FIG. 12, the operating means C5 has: a shaft member C5*b* supported through a support member C5*a* by the attaching member B2; a pushing member C5*c* so supported as to be rotatable around the shaft member C5*b* and adapted such that one end thereof pushes the semispherical portions C2*c* at the tips of the shafts C2*a;* and an operating lever C5*d* secured to the other end of the pushing member C5*c*. When the operating lever C5*d* is rotated in the direction toward the grip portion B3 as shown by two-dot chain lines in FIG. 12, the pushing member C5*c* is rotated clockwise in FIG. 12 against the compression coiled springs C4. Accordingly, the slide plates C2 and the movable holding pieces C3 can be slid, through the shafts C2*a,* to such positions as to release the clamping state, as shown in FIG. 15.

Figure 15:
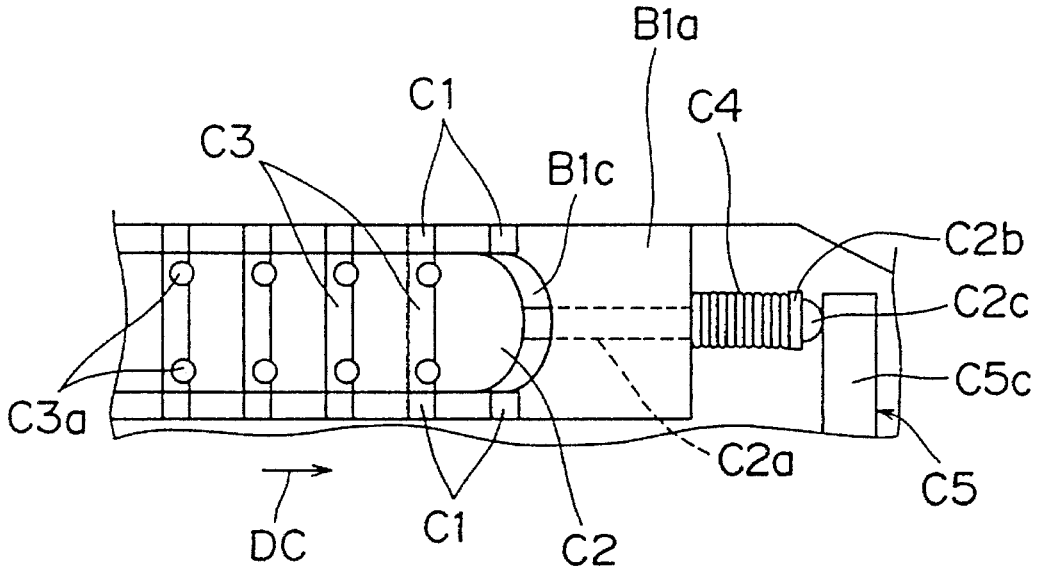
FIG. 15 is a partial plan view of the clamping surface at the time when the clamping state is released.
Figure 16:
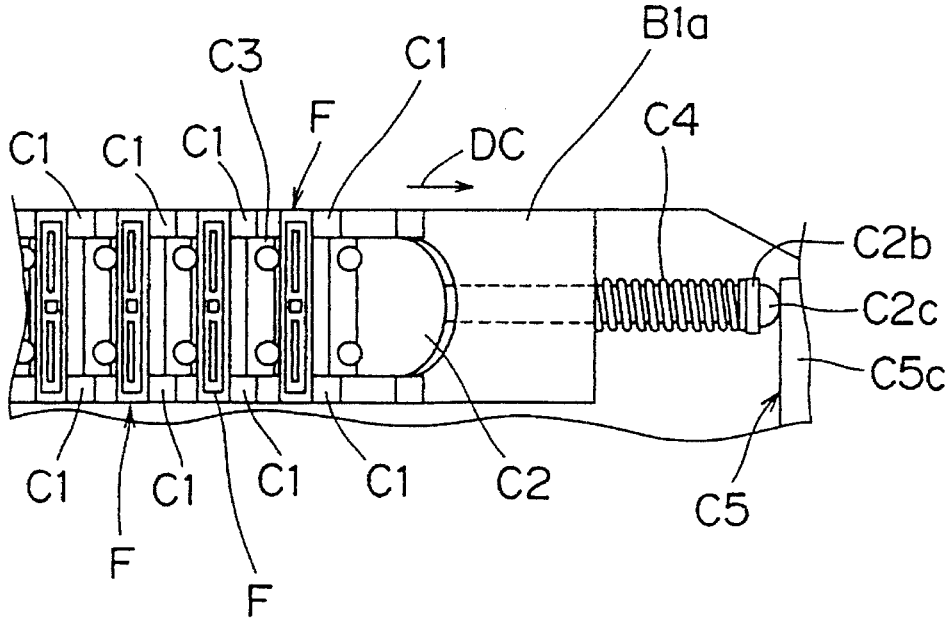
FIG. 16 is a partial plan view of the clamping surface illustrating the state where automotive fuses are clamped.
Figure 17:
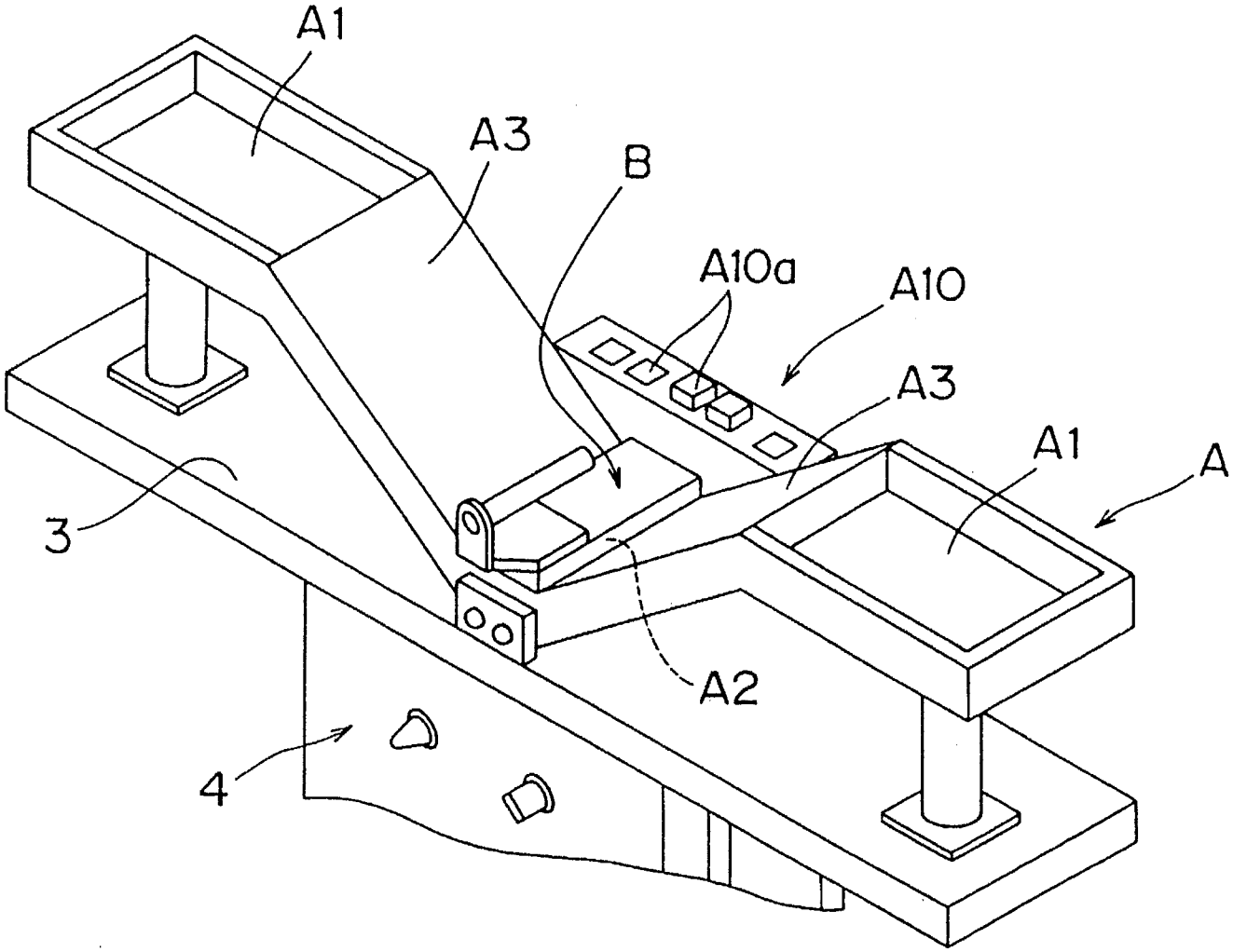
FIG. 17 is a perspective view of a step at which automotive fuses aligned by the feeding magazine are clamped by the inserting and attaching magazine.
Figure 18:
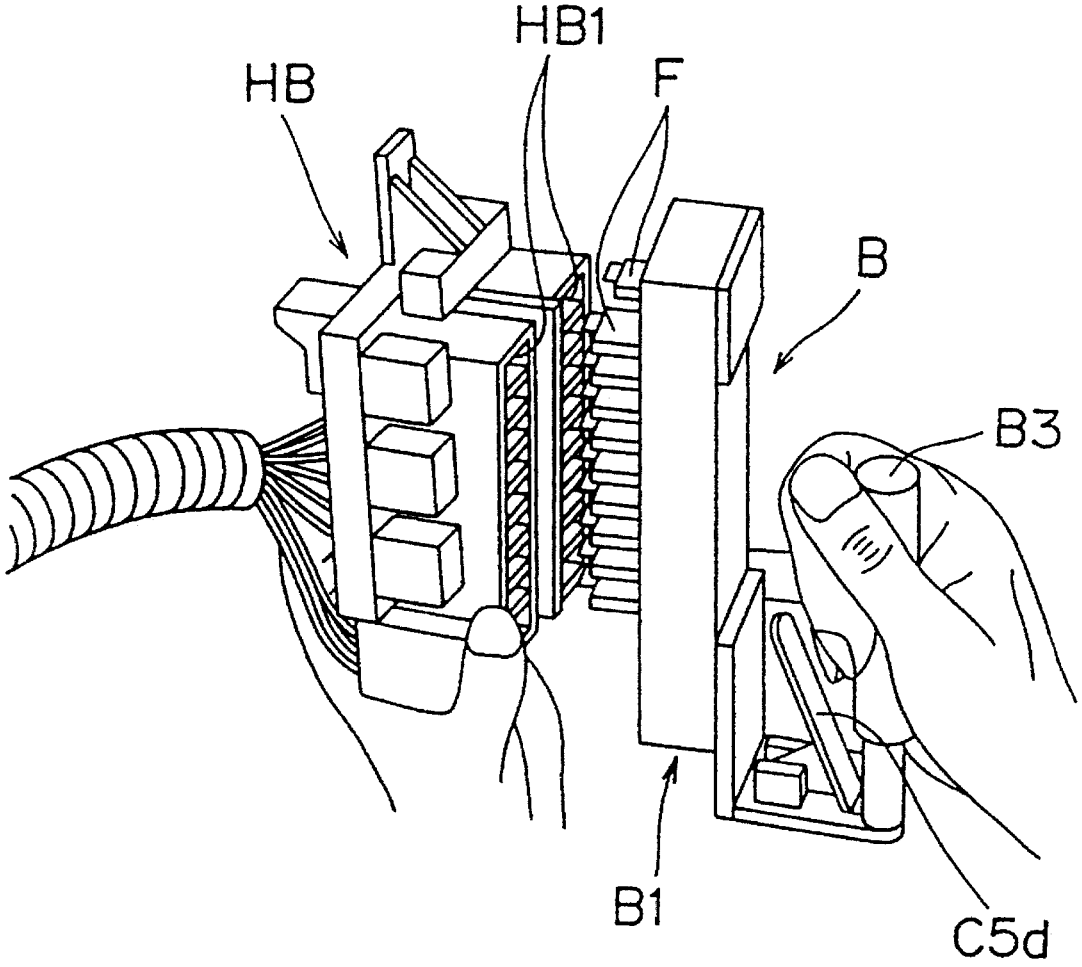
FIG. 18 is a perspective view illustrating an operation of inserting and attaching, into a fuse box, automotive fuses clamped by the inserting and attaching magazine.

With the state shown in FIG. 15, the clamping surface B1*a* of the inserting and attaching magazine B is put on the aligning portion A2 of the feeding magazine A from above as shown in FIG. 17 (at this time, the reference surface K of the feeding magazine A comes in contact with the clamping surface B1*a* of the inserting and attaching magazine B). A group of automotive fuses aligned on the aligning portion A2 is inserted between the movable holding pieces C3 adapted to clamp the fuses, and the pairs of stationary holding pieces C1 respectively corresponding to the movable holding pieces C3. Thereafter, when the operating lever C5*d* of the inserting and attaching magazine B is released, the group of automotive fuses F can be collectively clamped, as aligned, by the inserting and attaching magazine B as shown in FIG. 16. Then, the group of automotive fuses F thus collectively clamped, are collectively temporarily inserted into inserting and attaching grooves HB1 in a fuse box HB. Thereafter, the operating lever C5*d* is gripped to release the clamping state and the inserting and attaching magazine B is separated from the fuse box HB. At the temporary insertion and attachment above-mentioned, those portions of the automotive fuses F which are clamped by the inserting and attaching magazine B (about 3 mm in height), cannot be inserted into the fuse box HB but remain outside. In this connection, the automotive fuses F are then further pushed and perfectly inserted and attached into the fuse box HB.

According to the embodiment above-mentioned, a group of automotive fuses F aligned by the feeding magazine A in such a form as to be inserted and attached within a fuse box, can be collectively inserted, as clamped by the hand-type inserting and attaching magazine B, into the fuse box HB. The inserting and attaching magazine B for inserting and attaching automotive fuses F into the fuse box HB, is disposed as separated from the feeding magazine A for feeding the automotive fuses F to the inserting and attaching magazine B. Accordingly, the inserting and attaching magazine B can be made in a compact and lightweight design. Thus, when manually inserting and attaching the automotive fuses F into the fuse box HB included in a wire harness assembly set on an inspection drawing board, the automotive fuses F can be readily and efficiently inserted and attached with no errors.

Further, fuse clamping and releasing such fuse clamping can be readily conducted through an operation of the operating lever C5*d,* and with the operating lever C5*d* released, the fuse clamping state can be maintained by the action of the compression coiled springs C4. Thus, the automotive fuses F can be securely inserted into the fuse box HB with good maneuverability. Further, since the fuse clamping state can be maintained by the action of the compression coiled springs C4 with the operating lever C5*d* released, the inserting and attaching magazine B can be handled only with the grip portion B3 held, between the point of time that the automotive fuses F are clamped and the point of time that the automotive fuses F are inserted and attached into the fuse box HB. This is advantageous in view of handling.

Further, the same fuse box is generally commonly used for vehicles regardless of the presence or absence of optional equipment, and provision is made such that unnecessary automotive fuses for optional circuits are not inserted and attached. Accordingly, automotive fuses can be inserted and attached into a fuse box in a variety of manners. In the feeding magazine A according to the embodiment above-mentioned, the air cylinders A8 prevent automotive fuses F in the grooves A4*a* of the selected rows from being moved into the aligning portion A2. It is therefore possible to readily cope with any of a variety of inserting and attaching manners. Thus, the automotive fuse inserting and attaching operation can be conducted with further improved efficiency.

The present invention is not limited to the embodiment above-mentioned, but there may be disposed biasing means such as compression coiled springs or the like for biasing automotive fuses F in the grooves A4*a* toward the aligning portion A2. In this case, the automatic feeding of automotive fuses F can be further securely assured. The guide portions A3 may not be inclined.

The lids A5 shown in FIG. 5 may be made of an opaque material and may have inspection slits through which automotive fuses F under the lids A5 can be recognized.

The present embodiment is therefore to be considered in all respects as illustrative just for clarifying the technical concept of the present invention. The scope of the present invention is indicated by the appended claims rather than by the foregoing description and all changes which come within the meaning and range of equivalency of the claims are therefore intended to be embraced therein.

I claim:

1. An automotive fuse inserting and attaching apparatus comprising:

a feeding magazine which includes;

(a) aligning means for aligning automotive fuses to be inserted and attached into a fuse box, in such an arrangement as to be inserted and attached within the fuse box, and (b) feeding means for feeding predetermined automotive fuses to the aligning means; and hand-type inserting and attaching means for (i) collectively retaining, by way of a one hand operation, a group of automotive fuses aligned by said aligning means, such that the collectively retained group of automotive fuses can be conveyed to a fuse box, (ii) inserting the collectively retained group of automotive fuses so as to be received by the fuse box, and (iii) releasing the collectively retained group of automotive fuses received by the fuse box such that said hand-type inserting and attaching means is separable from the group of automotive fuses received by the fuse box.

2. An automotive fuse inserting and attaching apparatus according to claim 1, wherein said inserting and attaching means is dimensioned for collectively clamping automotive fuses that have:

a casing made of thin, flat, and plate-like resin;

a flange formed at lateral sides of a head portion of the casing and having shoulder-like projections which transversely project with respect to the lateral sides of a trunk of the casing;

a portion to be blown incorporated in said casing; and plate-like terminals extending from the portion to be blown and projecting downward from a lower end of the casing.

3. An automotive fuse inserting and attaching apparatus according to claim 1 wherein said feeding means includes a plurality of grooves parallel with one another and adapted to guide and automatically feed predetermined types of automotive fuses which are movably fitted into said grooves.

4. An automotive fuse inserting and attaching apparatus according to claim 3, wherein the aligning means includes an aligning portion which crosses terminal ends of said grooves to align a group of automotive fuses which are provided in said respective grooves so as to assume the arrangement that the fuses have when inserted and attached into the fuse box.

5. An automotive fuse inserting and attaching apparatus according to claim 4, wherein said feeding magazine is formed in a V shape and comprises:

a central horizontal portion which forms said aligning portion on which the group of automotive fuses are aligned in such the arrangement that the fuses are inserted and attached within the fuse box;

a pair of inclined guide portions between which said aligning portion is located, for feeding the automotive fuses to said aligning means so that the fuses are successively slid by own weight; and placing stands on which are placed a great number of automotive fuses of a variety of types having different capacities to be guided to said guide portions, said placing stands being disposed at both ends of said feeding magazine.

6. An automotive fuse inserting and attaching apparatus according to claim 5, wherein said aligning portion is opened at a top thereof such that the group of automotive fuses are clamped from above by said hand-type inserting and attaching means so as to be retained by said hand-type inserting and attaching means.

7. An automotive fuse inserting and attaching apparatus according to claim 5, wherein said guide portions have lids to be opened such that said grooves for guiding automotive fuses are opened.

8. An automotive fuse inserting and attaching apparatus according to claim 5, wherein said lids are formed such that automotive fuses in said grooves are visible.

9. An automotive fuse inserting and attaching apparatus according to claim 5, wherein said grooves extend to said placing stands and are gradually wider, at starting end portions thereof, in a direction toward said placing stands.

10. An automotive fuse inserting and attaching apparatus according to claim 4, wherein said inserting and attaching means is an inserting and attaching magazine including a clamping mechanism adapted to clamp the group of automotive fuses as aligned, clamping said group of automotive fuses being releasable, the group of automotive fuses clamped by said clamping mechanism being collectively conveyed to the fuse box.

11. An automotive fuse inserting and attaching apparatus according to claim 10, wherein said clamping mechanism of said inserting and attaching magazine comprises:

a plurality of stationary holding pieces formed on a clamping surface of a main body of said inserting and attaching magazine, said clamping surface being adapted to be opposite to said aligning portion of said feeding magazine, said stationary holding pieces project toward layout spaces of a group of automotive fuses to be aligned;

a plurality of movable holding pieces for clamping lateral sides of the heads of automotive fuses in cooperation with said stationary holding pieces, said movable holding pieces being collectively slid along said clamping surface between a position where automotive fuses are clamped and a position where clamping the automotive fuses is released;

biasing means for biasing said movable holding pieces to the position where automotive fuses are clamped; and operating means for sliding, against said biasing means, said movable holding pieces to the position where clamping the automotive fuses is released.

12. An automotive fuse inserting and attaching apparatus according to claim 1, further comprising selecting means for selecting automotive fuses to be conveyed by said feeding means.

13. An automotive fuse inserting and attaching apparatus according to claim 12, wherein said selecting means includes a stopper device being movable into any of a plurality of automotive fuse conveying grooves formed in said feeding means, said stopper device being adapted such that, when said stopper device is moved and projects into a selected groove, said stopper device prevents the automotive fuses in said selected groove from advancing into said aligning means.

14. An automotive fuse inserting and attaching apparatus according to claim 13, wherein the stopper device comprises:

air cylinders having rods being movable into grooves;

valves connected to said air cylinders;

a pressurized air supply source for supplying pressurized air through said valves;

control means for opening a selected valve out of said valves; and a select switch for driving said control means.

15. An automotive fuse inserting and attaching apparatus according to claim 2 wherein said feeding means includes a plurality of grooves parallel with one another and adapted to guide and automatically feed predetermined types of automotive fuses which are movably fitted into said grooves upon hanging down the trunks of the fuses in the grooves by utilizing the shoulder-like projections formed at the lateral sides of the trunks of the fuses.

16. An automotive fuse inserting and attaching apparatus comprising:

a feeding magazine having a feeding portion and an alignment portion, said feeding portion including a plurality of grooves extending parallel with one another and adapted to guide automotive fuses, said alignment portion being positioned at a terminal end of said grooves so as to collectively receive the automotive fuses from said feeding portion in a particular alignment arrangement which alignment arrangement corresponds with a fuse box arrangement the automotive fuses assume in a fuse box upon insertion therein;

a hand-type inserting and attaching magazine which includes;

a single hand grip member, a main magazine body attached to said single hand grip member, a clamping mechanism supported by said main magazine body, said clamping mechanism including a plurality of clamps adjustable between a fuse clamp retention position and a fuse release position, said clamps being aligned with the aligned automotive fuses collectively received in said alignment portion, and operating means for triggering a change in position of said plurality of clamps with respect to said fuse clamp retention position and said fuse release position whereby an operator can collectively retain the automotive fuses in the particular alignment arrangement, remove the particular arrangement of automotive fuses together with the retaining inserting and attaching mechanism, convey the particular arrangement of automotive fuses and retaining inserting and attaching mechanism to the fuse box, insert the fuses into the fuse box, release said clamps and separate said inserting and attaching mechanism from the fuses retained in the fuse box.

17. An apparatus according to claim 16 wherein said operating means includes a spring, a shaft and a hand activated lever, said lever being supported by said hand grip member and in contact with the shaft which is biased by said spring, and, when said lever is released, said clamps are positioned in the clamp retention position.

18. An apparatus according to claim 16 wherein said feeding portion includes a first sloped section and a second sloped section each having said grooves, and said alignment portion being centrally positioned between a lowermost end of each of said first and second sloped sections, and said alignment portion including a plurality of grooves aligned with the grooves in said sloped sections, and said alignment portion including a positioning projection which is centrally positioned on said alignment portion and extends transverse to the grooves formed in the alignment portion.

19. An apparatus as recited in claim 18 further comprising stopper means which includes stop members and means for shifting the stop members between a fuse stop position and a fuse release position, and a regulator for selectively positioning the stop members to achieve the particular alignment arrangement.

20. An apparatus as recited in claim 19 wherein said stopper means includes a plurality of cylinders and said stop members are rods slideable in said cylinders and a free end of said rods is disposed at a boundary portion between the aligning portion and one of said sloped portions.

* * * * *